US006114633A

United States Patent [19]

Duhancik

[11] Patent Number: 6,114,633

[45] Date of Patent: Sep. 5, 2000

[54] HERMETIC TERMINAL WITH CONDUCTOR PIN IDENTIFIER

[75] Inventor: David M. Duhancik, Fall River, Mass.

[73] Assignee: Tecumseh Products Company, Tecumseh, Mich.

[21] Appl. No.: 09/070,424

[22] Filed: Apr. 30, 1998

[51] Int. Cl.[7] ..... H01B 17/26

[52] U.S. Cl. ..... 174/152 GM; 174/17.08; 174/50.5; 174/135; 439/488; 29/842

[58] Field of Search ..... 174/50.55, 50.52, 174/152 GM, 135, 17.08, 50.5, 68.1, 257; 439/488, 491; 29/842, 845

[56] References Cited

U.S. PATENT DOCUMENTS

| | | | |
|---|---|---|---|
| 2,546,854 | 3/1951 | Foster et al. | 174/153 |
| 2,892,175 | 6/1959 | Frey | 339/113 |
| 3,109,054 | 10/1963 | Kuhnapfel et al. | 174/152 GM |
| 3,193,614 | 7/1965 | Richards | 174/112 |
| 3,229,623 | 1/1966 | Rubinstein et al. | 101/32 |
| 3,551,191 | 12/1970 | Elbling et al. | 427/108 |
| 3,912,851 | 10/1975 | Vrijssen et al. | 174/50.54 |
| 3,988,053 | 10/1976 | Dodenhoff | 339/278 C |
| 4,584,433 | 4/1986 | Bowsky et al. | 174/152 GM |
| 4,702,539 | 10/1987 | Cusick, III et al. | 439/588 |
| 4,781,619 | 11/1988 | Ikeda | 439/488 |
| 5,493,073 | 2/1996 | Honkomp | 174/152 GM |
| 5,850,693 | 12/1998 | Guran et al. | 29/884 |

FOREIGN PATENT DOCUMENTS

| | | | |
|---|---|---|---|
| 1551040 | 8/1979 | United Kingdom | 29/842 |
| 2 161 331 | of 1986 | United Kingdom | H01R 13/44 |

OTHER PUBLICATIONS

IBM Technical Disclosure Bulletin, vol. 24 No. 5 Oct. 1981.

*Primary Examiner*—Kristine Kincaid
*Assistant Examiner*—Dhiru R Patel
*Attorney, Agent, or Firm*—Baker & Daniels

[57] ABSTRACT

A hermetic terminal including a metallic wall having at least one opening therein through which a conductor pin extends, the conductor pin having a discontinuity on its end so that the relative electrical rating of the hermetic terminal can be ascertained through visual inspection of the terminal. A method is provided for use in a production facility whereby the relative electrical capacity of conductor pins, partially assembled hermetic terminals and completed hermetic terminals can be visually distinguished.

21 Claims, 1 Drawing Sheet

HERMETIC TERMINAL WITH CONDUCTOR PIN IDENTIFIER

BACKGROUND OF THE INVENTION

1. Field of the Invention

The present invention relates to hermetic terminals used to carry electrical current to a compressor. More specifically, the present invention relates to identifying relative electrical capacities of conductor pins used in hermetic terminal assemblies, and identifying relative electrical capacities of completed hermetic terminals.

2. Description of Related Art

Hermetic terminals of the general type of this invention are well-known in the art, and examples of same are illustrated in U.S. Pat. No. 3,988,053 to Dodenhoff, dated Oct. 26, 1976 and U.S. Pat. No. 3,551,191 to Elbling et al., dated Dec. 29, 1970. Terminals of this type traditionally comprise a generally cup-shaped metallic body having a plurality of openings in the end wall of the body, through each of which a conductor pin extends, the pin being hermetically sealed to the body, by means of a glass to metal seal, for example.

The aforesaid conductor pins have traditionally been constructed of solid stainless steel, such as No. 446 stainless steel. For many applications, solid stainless steel conductor pins are suitable because steel is a satisfactory electrical conductor for most applications, and particularly since the coefficient of thermal expansion of the steel pin relates closely to the coefficient of thermal expansion of the glass and the cup-shaped metallic body. Another desirable feature of stainless steel is that it is corrosion resistant, it being understood that in hermetic compressor terminals of the type with which the present invention is concerned, one end of the conductor pins will be extending outside of the enclosure housing of the compressor, and in many cases will be exposed to the ambient, whereby corrosion of the exposed ends is possible if the conductor pins are not constructed of a corrosion resistant material.

It will be understood that it is the usual practice to weld tabs to the exposed outer ends of the conductor pins, which tabs are adapted to receive terminal clips carried by the wiring which extends from the source of electrical power. Thus, the electrical current is transmitted from the wiring to the conductor pins by means of the mechanical interconnection which exists between the terminal clips and the tabs. The current then passes through the conductor pins into the enclosure, the pins being connected at their inner ends to the terminals of the compressor by any suitable means.

The problem with the above described solid stainless steel conductor pins is that steel possesses limited current carrying capability, which becomes a concern when used with a compressor which requires high current. For compressors involving high current applications, it is known to use a stainless steel pin having a copper core. This way, the corrosion-resistant and thermal properties of steel are coupled with the high electrical conductivity of copper. Because such copper-cored pins perform well when used in high current applications, they are widely used in hermetic terminals.

Manufacturers produce hermetic terminals for varying applications. Thus, manufacturers use both solid stainless steel conductor pins as well as conductor pins having the above described copper core. The problem manufacturers experience is that it is difficult to distinguish a stainless steel conductor pin having a copper core from a conductor pin of pure stainless. Thus, the two types of pins can possibly be confused.

It is known to mark the pins with identifiers such as colored tabs, but such an approach is inadequate because the tabs are typically installed in one of the last steps of terminal assembly, by which time a "mix-up" of the pins may have already occurred. Furthermore, colored tabs can be difficult to see when the terminal is welded into a refrigeration compressor, for example.

In a related application, with electrical cables having more than one conductor within an insulation layer, it has been known to mark one or more of the conductors with a groove, or other formation along the longitudinal axis of the conductor. Thus, with a long length of cable, the conductors at one exposed end can be identified at the other exposed end by locating the conductor having the identifying mark. The other conductors can then be identified by their positions relative to the conductor having a marking. However, this method is unsuitable as a cost effective means to clearly distinguish stainless steel conductor pins from those pins having a copper core.

SUMMARY OF THE INVENTION

The pin identifier of the present invention overcomes the above noted drawbacks by providing a conductor pin having a surface discontinuity on one or both ends of the pin. Such a discontinuity allows identification of the pin and is sufficiently durable to remain with the pin for the entire life of the hermetic terminal.

The pin identifier of the present invention is advantageous because it provides a cost effective means to clearly distinguish solid steel conductor pins from those pins having a copper core. Further, the present invention allows the pins to be distinguished by themselves and in completed terminals.

The pin identifier of the present invention provides a durable identifier which easily distinguishes solid steel pins from copper cored pins, yet at the same time, the present invention does not degrade the electrical conductivity nor does it interfere with installation into the metallic wall of the terminal into which it is installed. The present invention meets this object by providing a physical surface discontinuity on the end of the conductor pin instead of along the longitudinal axis.

In one form, the present invention is a hermetic terminal of the type used for carrying electrical current through a hermetic compressor housing. The terminal comprises a metallic wall having at least one opening therein through which a conductor pin extends. The conductor pin is hermetically secured in the opening. The pin has a cylindrical outer surface and opposite ends, with a surface discontinuity disposed on at least one of the ends, whereby pins having different physical or electrical characteristics, such as the presence or absence of a copper core, different plating, lengths, etc., can be visually identified.

In a preferred form, the discontinuity comprises a groove which extends completely across the end.

In another preferred form, the ends of the pin are substantially flat and the discontinuity can be formed as an indentation in the flat end. Further, the indentation can be formed as an alphanumeric character.

In another preferred form, the identifier pin of the present invention has an electrically conductive core and an electrically conductive layer disposed peripherally around the core. The core typically has a higher electrical conductivity than the layer, the core being typically made of copper whereas the layer is typically made from stainless steel.

In another form, the present invention provides a method of visually distinguishing relative electrical capacity of hermetic terminals. The method comprises the steps of furnishing a first supply of solid conductor pins and furnishing a second supply of conductor pins having an inner core and an outer layer disposed peripherally around the inner core. In the second supply of pins, the core is not readily visible and the two types of pins cannot be optically distinguished by a computer vision system. Next, one of the solid pins and the cored pins are marked with a surface discontinuity on at least one end of the pins, thereby forming one set of marked pins and another set of unmarked pins. Finally, the marked pins are selected for assemblage in a first set of hermetic terminals whereas the unmarked pins are selected for assemblage into a second set of hermetic terminals. Thus, the markings on the ends of the pins enable the relative electrical capacity of the hermetic terminals to be visually distinguished.

In a preferred method for visually distinguishing electrical capacities of hermetic terminals, the marked pins have a copper core whereas the unmarked pins are comprised of solid stainless steel.

One advantage of the pin identifier of the present invention is that it will not "wear off" during various fabrication processes. For example, a longitudinal marking placed on a conductor pin would not work with hermetic terminals of the present invention because such a longitudinal mark, or groove, could wear off during tumbling processes. By contrast, the pin identifier of the present invention, which is placed on the ends of the pin, is less subject to tumbling processes and therefore remains with the conductor pin throughout its life.

Another advantage of the pin identifier of the present invention is that it does not decrease the electrical conductivity of the pin. By contrast, a longitudinal marking extending along a conductor pin would decrease the cross sectional area of the pin and thereby decrease the available area in which electrical current can travel. In turn, the electrical conductivity of such a pin is decreased. Advantageously, the present invention avoids this problem by placing the pin identifier on the ends of the pin and therefore does not decrease the cross sectional area through which the current travels and thus does not decrease the electrical conductivity of the pin.

Still another advantage of the present invention involves the installation of the conductor pins into openings in the metallic terminal wall. A pin with a longitudinal discontinuity introduces an unnecessary void between the opening in the metallic wall and the circumferential surface of the pin. By contrast, with the present invention, because the pin identifier is placed on the ends of the pin, there are no voids introduced between the opening in the metallic wall and the circumferential surface of the pin. Thus, the likelihood of the failure of the terminal is decreased.

Still another advantage of the present invention is its cost. The present invention provides an efficient, low cost pin identifier which allows solid stainless steel pins to be easily distinguished from conductor pins having a copper core.

Yet another advantage of the present invention is that it provides a method to distinguish copper cored pins from those comprised of solid stainless steel in a production facility without undue expense or disruption to the operating procedures in such facility.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Although the drawings represent embodiments of the present invention, the drawings are not necessarily to scale and certain features may be exaggerated in order to better illustrate and explain the present invention. The exemplification set out herein illustrates embodiments of the invention, in several forms, and such exemplifications are not to be construed as limiting the scope of the invention in any manner.

DETAILED DESCRIPTION OF THE INVENTION

Figure 1:
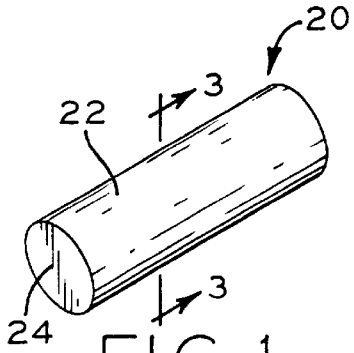
FIG. 1 is a perspective view of a solid conductor pin.
Figure 3:
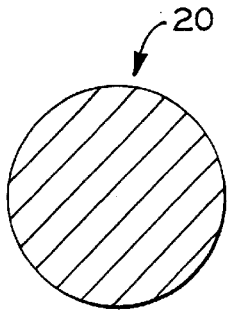
FIG. 3 is a cross sectional view taken along line 3—3 of the conductor pin of FIG. 1.

With reference to FIG. 1, a solid conductor pin 20 has cylindrical surface 22 and flat end 24. Conductor pins are used in hermetic terminals, such as terminal 26 shown in FIG. 7, which terminals connect power to the electric motor of a compressor (not shown), for example. As shown in cross section in FIG. 3, conductor pin 20 is comprised of a single material throughout. Typically, pin 20 is made from stainless steel, such as No. 446 stainless steel, although other metals such as iron-nickel alloys, nickel plated steel and the like can be used for pin 20.

Figure 2:
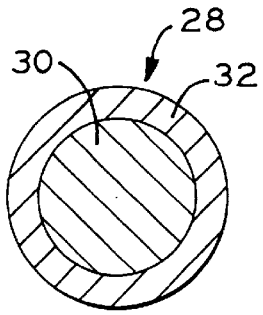
FIG. 2 is a cross sectional view taken along line 2—2 of the conductor pin of FIG. 1*a;*
Figure 1A:
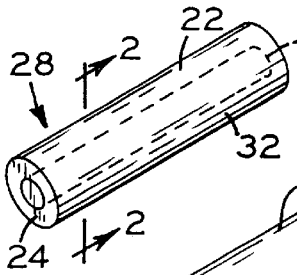
FIG. 1*a* is a perspective view of a conductor pin having a copper core, the core being shown in phantom lines.

Now referring to FIGS. 1*a* and 2, an alternative conductor pin 28 has conductive core 30 and layer 32 peripherally disposed around core 30. Core 30 typically is made from copper whereas layer 32 is typically made from stainless steel. However, core 30 and layer 32 can be comprised of many other conductive metals, such as nickel, nickel-iron alloys, etc. The exact material chosen for core 30 and layer 32 is not essential to the present invention, other than to note that pin 28, having a layer and a core is indistinguishable from pin 20, which is composed of a solid material throughout. Thus, as shown in FIG. 1*a,* pin 28 also has cylindrical surface 22 and flat end 24, and possesses the same dimensions as does pin 20. Thus, to the naked eye, pin 20 and pin 28 are virtually indistinguishable.

Figure 7:
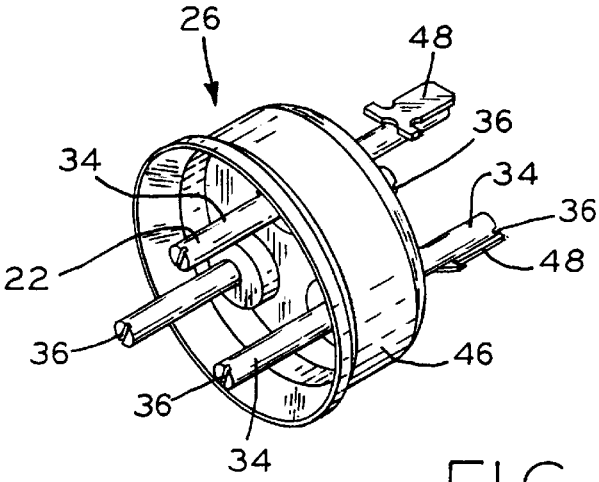
FIG. 7 is a perspective view of a hermetic terminal according to the present invention.

Hermetic terminals, such as terminal 26 shown in FIG. 7, are adapted to use both solid pins, such as pin 20, and pins having a more highly conductive copper core, such as pin 28. In fact, two hermetic terminals, one being adapted for high current transmission and using pin 28, and the other being adapted for normal lower current transmission and using pin 20 would be difficult to distinguish upon visible inspection, unless some measure was taken to identify one of the terminals. That is, pin 20 and pin 28 are used interchangeably in terminal 22 depending upon the electrical requirements of the particular application to which terminal 22 is to be subjected. Thus, it is necessary to identify the pins so that the pins and terminals do not become mixed.

Figure 4:
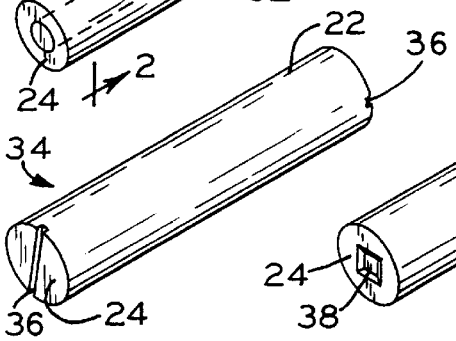
FIG. 4 is a perspective view of one embodiment of the present invention.

As shown in FIG. 4, conductor pin 34 is shown having cylindrical surface 22 and substantially flat end 24. A discontinuity, or indentation is formed as groove 36 in flat end 24 of pin 34. Pin 34 can be a conductor pin having a copper core, for example, and thus groove 36 serves as an identifier for pin 34. If all pins having a copper core are marked with an identifier, such as groove 36, then copper cored pins can be visually distinguished from pins made from a solid material throughout. Thus, the present invention provides an identifier for conductor pins used in hermetic terminals. Although groove 36 can vary substantially in width and depth, it has been found that a groove 36 having a width of 0.025 inches±0.005 inches and a depth of 0.010 inches±0.005 inches and extending substantially completely across flat end 24 performs satisfactorily.

The identifier of the present invention is preferably used with copper cored pins, such as pin 28, because pins having a copper core are typically used with less frequency than those of pure stainless. Thus, it is a simple matter of economics that the identifier is used with copper cored pins instead of solid steel pins. However, the identifier of the present invention would work equally well on solid pins, such as pin 20. Practice of the present invention merely requires that the manufacturer be consistent in placing the identifier on one of the copper cored pins or the solid pins, but not both.

Figure 5:
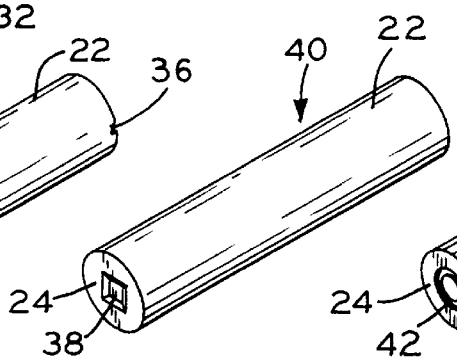
FIG. 5 is a perspective view of a second embodiment of the present invention.
Figure 6:
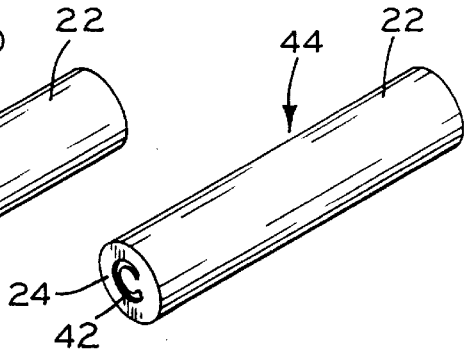
FIG. 6 is a perspective view of a third embodiment of the present invention.

The pin identifier of the present invention is not limited to groove 36 shown in FIG. 4. As shown in FIG. 5, square recess 38 on pin 40 is a suitable identifier. Similarly, in FIG. 6, indented alphabetic letter 42 identifies pin 44. Indeed, the pin identifier can be formed in a virtually endless variety of shapes and those shown are only examples. What is important to the practice of the present invention is that the pin identifier, such as groove 36, square recess 38 or letter 42 forms a physical surface discontinuity, or indentation, on flat end 24. Conductor pins are subject to various production processes, such as tumbling and etching, whereby a previous identifier could "wear off." It has been found that a surface discontinuity or an indentation, such as groove 36, square 38 or letter 42 can withstand the various production processes to which the pin is subjected and yet such identifier remains with the pin throughout its life.

As shown in FIG. 7, a pin identifier, namely groove 36, is used with a hermetic terminal 26 of the present invention. Hermetic terminal 26 has metallic, cup-shaped wall 46 through which conductor pins extend. Tabs 48 are installed on one side of the conductor pins and connect to clips (not shown), which clips are carried by a source of electrical power (not shown). Hermetic terminal 26 can be installed in a compressor housing, where it would be used to transmit electricity to the motor disposed within the housing. As shown in FIG. 7, pins 34, having grooves 36, are installed in terminal 26. Typically, the pin identifier of the present invention is present on all of the pins installed in any individual terminal as shown in FIG. 7. Furthermore, as shown in FIGS. 4 and 7, the pin identifier of the present invention is preferably present on both ends of the conductor pin. However, it is possible that less than all of the pins will have a pin identifier, or that the pins will have a pin identifier present on only one end. Such embodiments are nonetheless within the scope of the present invention.

The identifier of the present invention can be placed on conductor pins by one of several methods that are widely known to one of ordinary skill in the art. For example, referring to FIG. 4, groove 36 can be placed on pin 34 by mechanically indenting, embossing, stamping, staking or cutting the identifier into the end of the pin.

In a production facility, the present invention provides an efficient method for easily distinguishing copper cored pins from those comprised of solid stainless steel. Such a method, for example, would involve furnishing a first supply of solid conductor pins, such as pin 20 shown in FIG. 1. A second supply of conductor pins having an inner cooper core such as pin 28 shown in FIG. 1*a* are also supplied. Next, either the solid pins 20 or the cored pins 28 are marked with a surface discontinuity, such as indentation 36 shown in FIG. 4. Thus, two sets of pins have been formed, one of which set is marked on the ends with indentation 36 whereas the other set is unmarked. Finally, the marked pins are selected for assemblage in a first set of hermetic terminals whereas the unmarked pins are selected for assemblage in a second set of hermetic terminals. Using this method, the cored pins can be visually distinguished from the solid pins and in turn, the partially and fully assembled hermetic terminals can also be distinguished.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A hermetic terminal of the type used for carrying electrical current through a hermetic compressor housing, said terminal comprising:

a metallic wall having at least one opening therein through which a conductor pin extends, said pin being hermetically secured in said at least one opening;

said pin having a cylindrical outer surface and opposite ends; and said pin having a surface discontinuity disposed on at least one of said ends, whereby said pin can be visually identified.

2. The terminal of claim 1, wherein said discontinuity comprises a groove.

3. The terminal of claim 2, wherein said groove extends completely across said at least one of said ends.

4. The terminal of claim 1, wherein said ends are substantially flat.

5. The terminal of claim 4, wherein said discontinuity is an indentation in at least one of said flat ends.

6. The terminal of claim 5, wherein said indentation is formed as an alphanumeric character.

7. The terminal of claim 1, wherein:

said pin has an electrically conductive core of one metal and an electrically conductive outer layer of a different metal disposed peripherally around said core.

8. The terminal of claim 7, wherein said core has a higher electrical conductivity than said layer.

9. The terminal of claim 7, wherein said core is made of copper and said layer is made of stainless steel.

10. A conductor pin for use in a hermetic terminal, said pin comprising:

an electrical conductor having a cylindrical shape and having opposite ends; and an indentation disposed on at least one of said ends, whereby said pin can be visually identified.

11. The pin of claim 10, wherein said ends are substantially flat.

12. The pin of claim 10, wherein said indentation is square shaped.

13. The pin of claim 10, wherein said indentation is formed as an alphanumeric character.

14. The pin of claim 10, wherein:

said pin has an inner core, said inner core comprised substantially of copper; and said pin has an outer layer disposed peripherally around said inner core, said outer layer comprised substantially of stainless steel.

15. A method for assembling hermetic terminals for compressors comprising:

furnishing a first supply of solid conductor pins;

furnishing a second supply of cored conductor pins having an inner core of one metal and an outer conductive layer of a different metal disposed peripherally around the inner core;

marking one of the solid pins or the cored pins with a surface discontinuity on at least one end thereof, thereby forming one set of marked pins and another set of unmarked pins;

selecting one set of said marked pins and assembling them in a first set of hermetic terminals; and selecting one set of said unmarked pins and assembling them in a second set of hermetic terminals.

16. The method of claim 15 wherein:

the outer layer is comprised substantially of stainless steel and the inner core is comprised substantially of copper.

17. The method of claim 15, wherein the ends of the solid pins and cored pins are substantially flat.

18. The method of claim 15, wherein the first supply of conductor pins are marked.

19. The method of claim 15, wherein the second supply of conductor pins are marked.

20. The method of claim 15, wherein the surface discontinuity comprises an indentation formed as a groove.

21. A method for assembling hermetic terminals for compressors comprising:

furnishing a first supply of conductor pins each having physical and electrical characteristics;

furnishing a second supply of conductor pins each having at least one physical or electrical characteristic differing from the pins of said first supply of pins;

marking either the first pins or the second pins with a surface discontinuity on at least one end of said first pins or second pins, thereby forming one set of marked pins and another set of unmarked pins;

selecting the marked pins and assembling them in a first set of hermetic terminals; and selecting the unmarked pins and assembling them in a second set of hermetic terminals.

* * * * *

UNITED STATES PATENT AND TRADEMARK OFFICE

CERTIFICATE OF CORRECTION

PATENT NO. : 6,114,633
DATED : November 5, 2000
INVENTOR(S) : David M. Duhancik

It is certified that error appears in the above-identified patent and that said Letters Patent is hereby corrected as shown below:

Column 6,
Line 39, delete "whereby" and replace with -- wherein --.
Line 40, after "identified" insert -- by said surface discontinuity --.
Line 45, after "said" insert -- at least one of said --.
Line 45, delete "are" and replace with -- is --.
Line 60, delete "comprising" and replace with -- having --.
Line 61, delete "an electrical conductor" and replace with -- said pin --.
Line 63, delete "an indentation disposed" and replace with -- a surface discontinuity provided --.
Line 64, delete "whereby" and replace with -- wherein --;
Line 65, after "identified" insert -- by said surface discontinuity --.

Column 7,
Line 1, delete "indentation" and replace with -- surface discontinuity --.
Line 3, delete "indentation" and replace with -- surface discontinuity --.
Line 18, delete "one of the solid pins or the cored pins" and substitute therefor -- at least one end of each solid pin or at least one end of each cored pin --.
Line 19, after "discontinuity" delete "on at least one end thereof".

Signed and Sealed this

First Day of October, 2002

*Attest:*

*Attesting Officer*

JAMES E. ROGAN
*Director of the United States Patent and Trademark Office*